US006061038A

United States Patent [19]

Washburn

[11] Patent Number: 6,061,038

[45] Date of Patent: May 9, 2000

[54] MULTI-DEFLECTION CRT DISPLAY

[76] Inventor: Clayton A. Washburn, 24 Andrea La., Thornwood, N.Y. 10594

[21] Appl. No.: 08/754,299

[22] Filed: Nov. 20, 1996

Related U.S. Application Data

[60] Provisional application No. 60/007,438, Nov. 21, 1995.

[51] Int. Cl.[7] ..... G09G 1/06

[52] U.S. Cl. ..... 345/12; 345/13; 348/383; 313/415; 313/409

[58] Field of Search ..... 345/12, 13; 348/383; 313/467, 469, 415, 409, 2.1, 412

[56] References Cited

U.S. PATENT DOCUMENTS

| | | | |
|---|---|---|---|
| 3,567,985 | 3/1971 | Goodman | 313/415 |
| 4,635,105 | 1/1987 | Favreau | 348/383 |
| 4,896,082 | 1/1990 | Geiger | 315/368 |
| 4,931,786 | 6/1990 | Selby, III | 345/31 |
| 5,291,102 | 3/1994 | Washburn | 315/383 |
| 5,418,426 | 5/1995 | Rilly . | |
| 5,473,217 | 12/1995 | Hull | 313/2.1 |
| 5,585,691 | 12/1996 | Washburn | 313/452 |
| 5,694,003 | 12/1997 | Takahashi et al. | 348/383 X |
| 5,712,525 | 1/1998 | Hull | 313/2.1 |

*Primary Examiner*—Dennis-Doon Chow
*Assistant Examiner*—Amr Awad
*Attorney, Agent, or Firm*—Clark & Brady

[57] ABSTRACT

A display has a cathode ray tube (CRT) provided with a multiplicity of electron beams or beam sets. Each of the beams has its own auxiliary beam control assembly including deflection means. Each beam assembly is directed to energize a prescribed portion of the display format area. The typical application may employ two to six beam sets and is useful to reduce total depth and bulk of CRT's having high aspect ratios and/or large size. The displayed area shows substantially no visible boundaries (tiling) between portions.

16 Claims, 2 Drawing Sheets

MULTI-DEFLECTION CRT DISPLAY

CROSS REFERENCE TO RELATED APPLICATIONS

This application claims priority of U.S. Provisional Application serial number 60/007,438, filed Nov. 21, 1995.

FIELD OF THE INVENTION

This invention relates to cathode ray tube displays and, in particular, to means for increasing the display size, aspect ratio, and resolution while maintaining brightness and holding such factors as depth, volume, weight, scan speed, power, and gun performance requirements within practical limits.

BACKGROUND

The moderate size, direct-view CRT display which is in general use is generally considered superior to other display methods. The CRT has wide color range and high purity, thereby providing vivid images. It has gray scale fidelity, a wide viewing angle and provides good display of motion. It can provide high resolution with sharpness of detail and adequate overall efficiency. It has also been substantially the lowest cost display available. Its one substantial negative characteristic is its bulk—especially depth and, consequently, its weight. Exacerbating this negative feature are two trends of major significance to the instant invention.

1—Recent consumer preference has been for larger display size, partially responding to high definition television (HDTV) development, which also calls for higher resolution and a wider aspect ratio.

2—Improvements in IC memory, logic and control chips, which store, process and scan-convert between media standards, as well as improved signal transmission means is rapidly leading to demand for multi-media access via information display. Again the pressure is for higher resolution and increased display size parameters.

The increased size of a conventional CRT adds bulk and further requires higher electron beam performance to maintain brightness and resolution. Illustrative of this is that demand has been met by more complex and expensive CRT projection units. There is even demand for the large and very bulky direct view CRT, and the technology to meet the contemplated size, wide view angle, and resolution of HDTV is still evolving.

The improvements in electronic elements is also illustrated by HDTV, which has developed a very efficient digital signal capable of scan conversion flexibility. Another improvement, sometimes referred to as tiling, allows stacking of a number of standard displays to make a large display. In these display subsections, the framing is made as narrow as possible, but the display appears as if seen through a heavy grid. Scan conversion divides the large picture's information into properly selected segments fed to respective subsections. In one example shown in U.S. Pat. No. 5,635,105, the tiles are partially deleted by combining a row of small sub-elements in one bulb. But these prior art examples do not have the means for precisely matching the subsections to make their borders invisible, or substantially so, even where they are not framed.

Two examples will illustrate the state of the art of displays to which this disclosure may be applied. Transmission standards for high definition television (HDTV) are rapidly being promulgated. Some optimum utilization calls for large size and approximately 1000 line resolution. The ratio is 16/9 (1.8/1) as compared to 4/3 for NTSC. The larger aspect ratio and/or increase in display size leads rapidly to excess depth, bulk and weight for direct view CRT systems and to higher power requirements and to extreme difficulty in achieving high resolution. Thus, the cost becomes excessive.

Current demand for larger size was initially met by color projection sets having three projection tubes. These have not yet achieved the size or resolution expected for HDTV but their size is quite adequate for much typical viewing. However, it is interesting to note that large-size, direct-view sets, e.g., up to about 36" diagonal, have more recently become available. In spite of bulk there is some customer preference for direct view over projection sets of similar or even larger size.

The second example pertains to computer terminals. There is demand for larger, high resolution displays for graphics and for the capability to display two standard 8.5×11" full pages. Again, the aspect ratio can be about 1.5/1 (standard 35 mm film). In this case, display depth and bulk is again at a premium, and demand is often met by flat displays at a much higher price. These examples will be used to describe preferred embodiments of this invention.

SUMMARY OF THE INVENTION

While more generally applicable, this invention pertains particularly to direct view CRT displays having large display formats and/or high format aspect ratios. The invention provides two or more electron beams, or beam sets, each of which has its own beam control means and each of which is directed to a prescribed portion of the display format area. The invention can be adapted to any of the well-known means for generating either monochrome or color displays, but Dynamic Color Separation (DCS) displays such as those described in applicant's U.S. Pat. No. 5,291,102 already have the characteristics necessary for direct application of this invention. Scan conversion circuitry provides for separation and routing of the display's video content to prescribed display portions to enable separate scanning of each portion's format area. Scan conversion is accomplished, for example, by storing input signal information in a table location corresponding to its display location and then reading out the signal information for the desired, new display location. As shown in this patent the format area for DCS may include triads of primary color stripes having the pattern RGBRGB or RGBGRGB.

Objects of this invention are to provide a direct-view CRT display package having a large aspect ratio and/or large size but reduced weight and bulk. A second objective is to decrease power requirements and to achieve high resolution at lower cost while maintaining high brightness. A third objective is to provide a large display made up of precisely matched subsections that leave no visible boundaries, or "tiling" pattern. A fourth objective is to provide a display with a multiplicity of independent beams, each of which uses dynamic color separation indexed to its precise area of the display.

These and other objectives and advantages are achieved by providing a cathode ray tube typically having two or more electron beams or beam sets with associated control and scanning elements—one for each side or subsections of the format. They are accompanied by the essential memory, circuit control and scan conversion and means to adapt from a specified input signal to means for individually controlling the multi-output generated beams. One color display control system particularly adaptable to meet the requirements herein has been described in applicant's U.S. Pat. No.

5,291,102 for dynamic color separation control of color. However, the invention can be applied to other-such as conventional shadow mask color displays, to monochrome or to projection and to other CRT functions. In such cases either adequate control of individual beams is provided or some tile visibility is allowed with reduced control.

DETAILED DESCRIPTION OF THE DRAWINGS

Figure 1:
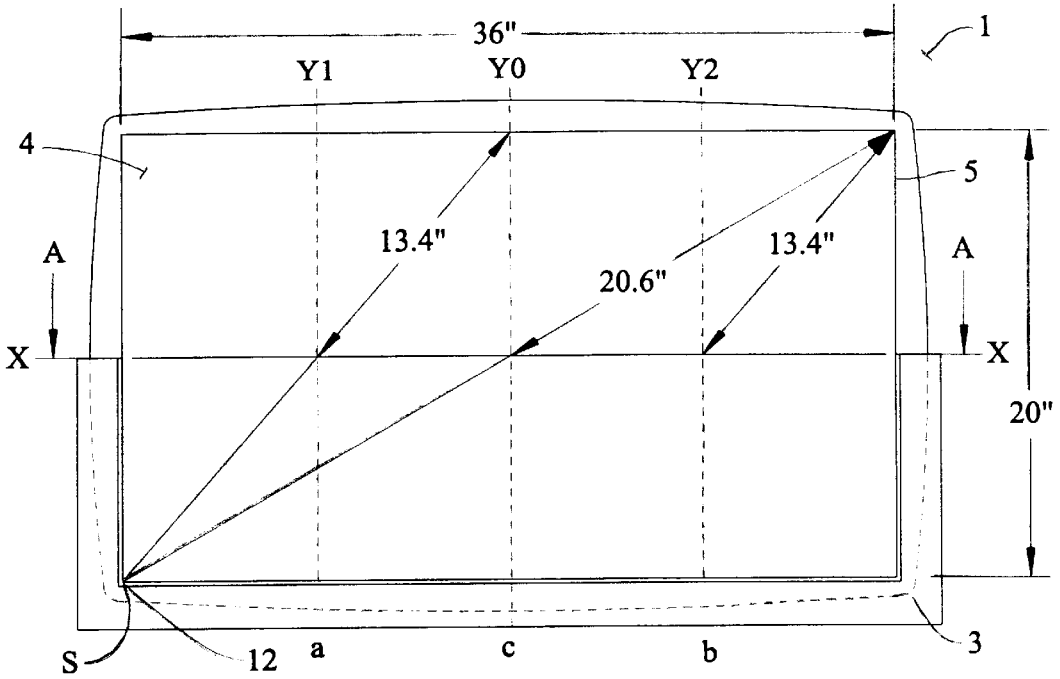
FIG. 1 is a graphical illustration showing the differences in dual deflection geometry in comparison to an equivalent conventional single beam CRT.
Figure 2:
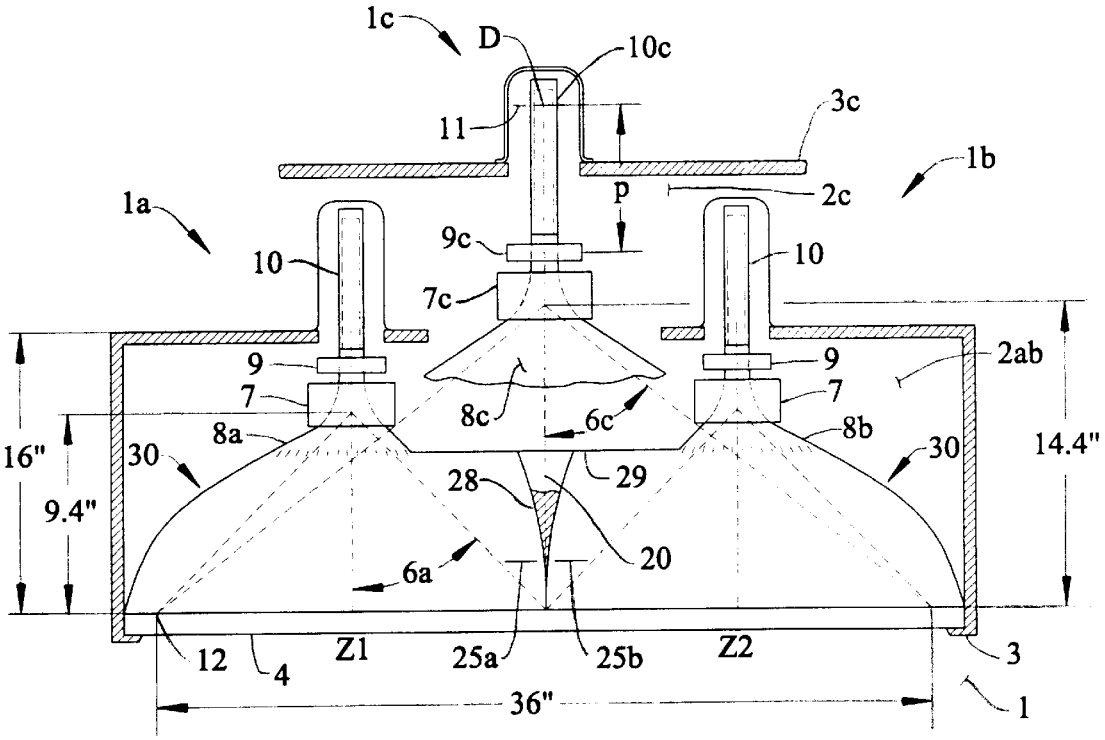
FIG. 2 is a horizontal cross section of a double deflection CRT assembly in accordance with the invention in juxtaposition with a single beam CRT for a screen of the same width.

FIG. 1 is a front view of a large, direct-view CRT display 1 having a high aspect ratio typical of the HDTV format. FIG. 2 illustrates a cross section of a dual beam display in accordance with the invention, taken along line A—A of FIG. 1. This display includes displays 1*a* and 1*b*. FIG. 2 also shows a conventional single beam display 1*c* in phantom lines. The CRT assembly of FIG. 1 includes a cabinet 3 and FIG. 2 illustrates a cabinet 3*c* required for the conventional CRT assembly 1*c*.

Referring to FIGS. 1 and 2, a faceplate 4 includes a display format area 5 which is 20" high, 36" wide and thus has an aspect ratio of 1.8. The full format diagonal is 41.2", which is about 20% larger than is in current production. For the single beam CRT 1*c*, the deflection axes are x (horizontal) and y (vertical) at the center of the format. The corresponding z (undeflected beam) is $Z_0$ as shown in FIG. 2. The maximum (diagonal) deflection is 20.6" (the beam gun is centrally located). The two beam CRT 1*a* and 1*b* allows the format to be divided into left and right sections, respectively A and B, having corresponding axes $y_1$, $z_1$, and $y_2$, $z_2$. In this case the maximum diagonal defection is 13.4" for each. The corresponding deflection geometries are illustrated in FIG. 2.

The maximum beam deflection of the beam gun for display 1*a* is shown at 6*a*, while that for the beam gun for display 1*c* is shown at 6*c*. Direct comparison between the dual beam deflection, 6*a*, and the single beam deflection, 6*c*, may now be made. Assuming a maximum diagonal deflection of 55%, the single beam deflections are x=51.31° and y=34.75°. The dual beam deflections are x=43.69°, y=47.31°. The corresponding Z beam throw distances from faceplate 4 to center of deflection at deflection yokes 7, as shown in FIG. 2, are 14.4" and 9.4°, respectively. These throw distances are important because they determine the cabinet (3) depth. The direct single to dual ratio is 1.53. But, as will be discussed, the factors in enlarging a display while maintaining constant performance are not linear; they are compounded.

The principal beam generation and control elements include deflection yokes 7*a*, 7*b* or 7*c* and focus means 9*a*, 9*b* or 9*c*. These elements are shown mounted on the neck section of CRT bulb funnels 8*a*, 8*b* or 8*c* and the electron gun assemblies 10*a*, 10*b* or 10*c* are within the neck. These are well known components as used in conventional displays.

Special requirements for a DCS display have been described in my prior U.S. Pat. No. 5,291,102. Focusing means 9 may be external EM or PM as shown, internal ES as part of the gun structure or a combination of both. These components are shown to illustrate a comparison of performance factors of the single and dual beam assemblies. The parameters of importance are the effective, or equivalent, values of beam size D at gun cross-over 11, the angle of beam divergence leaving the gun, the distance P from crossover to center of focus field 9 and the beam path distance Q from focus field center to a point 12 (as example) of maximum deflection of beams 6*a*, or 6*c*. Focused spot size S is then given by:.

$$S=D\ Q/P=MD.$$

Each of the dual beam sections is comparable in size to typical displays for which P=4" and focus-to-deflection distance is 1.5" approx. Then Q is 16.4"+1.5"=17.9". Spot magnification is about 3 at the center and 4.5 at the diagonals. This resolution performance dictates depth of an equivalent single beam CRT. Since comparison is made at the same maximum deflection of 55°, then Q as well as Z throw distances have the same ratios as do the diagonal distances. This ratio is 20.6/13.4=1.53. Thus the total dual beam neck length of 1.5"+4"+2"=7.5" for the rear end hardware and clearance translates to 11.5" for the single gun assembly. Directly comparable cabinet depths are 18.5" vs 27.5". However, complicating factors make the ratio even greater. To begin with, the diverged beam at the focus and deflection field regions is larger for the single beam tube. This requires larger and/or higher performance deflection, focus, and gun assembly components 7*c*, 9*c* and 10*c*. The longer beam path is more affected by electron repulsion. Compensation for the single beam's loss in resolution can therefore also require increased neck length and higher beam voltage.

Next, if the two versions are to have the same performance, brightness must be the same. Therefore the single gun must provide twice the beam current of each dual gun. But spot size increases with beam current. Again, the single beam must have a higher resolution gun, and increase in neck length and/or high voltage. The single gun must be driven at twice the velocity over the format surface. Circuit response must be doubled. All of these complicating factors, which are involved in making a larger single gun display, rapidly add to component and circuit performance, to energy consumption and to cost and bulk. Examination of current production shows a price increase of about 4 to 1 for the large single gun set compared to a set the size of one side of a dual gun set in accordance with the invention. A comparison of horizontal scan energy (the major use) without adding any of the complexity factors shows the single beam requires 1.38 times more energy than both dual beams. In actual practice with other factors and increased HV the energy ratio would be closer to double. Thus the dual beam display can provide higher performance at substantially less cost and with less bulk in a shallower package than can the single beam CRT where a large aspect ratio is required. It even becomes preferable for a standard NTSC (4 to 3 aspect ratio) display when size is large.

The dual-beam or multiple-beam display has two further requirements which typically are not found in the conventional display. These are increased control of distortions, specifically the merging of the parts of the display along the $Y_0$ axis should be seamless. Technology that will provide this feature is discussed in the referenced patent for DCS and in other places. DCS provides higher performance beam efficiencies, resolution, etc, than in current state-of-art displays, and also provides indexed control able to match subsection edges. In such applications, the index elements are typically part of the screen pattern. Alternative index elements 25*a* and 25*b* of FIG. 2 suitable for defining a boundary edge are shown corresponding to the C boundary between A and B of FIG. 1. The arrangement is particularly suited to the multiple-beam display because the index elements may be located outside of and independent of the format area portions. Thus, they are not visible.

The dual beam also requires a scan conversion circuit. In this case the scan conversion divides the input signal content into two parts for individual control of the two beams or beam groups. The video content for each side is completely different and independently selected. But the scan rates are typically the same. They may be identical in position sequence or they may be reversed or phase shifted to provide an optimum display appearance. The general procedures for scan conversions are state-of-art as noted for tiled displays and will not be further detailed herein except for specific requirements.

The above dual beam example may be extended to multiple beams and this would be appropriate where a still larger display size or less bulk is required. For example, a large NTSC display would be divided into four subsections. HDTV would conveniently divide into 6 subsections. Construction of such a display may start with a flat (plate-glass) faceplate. The shortened cone sections 30 of the funnels of assemblies 1*a* and 1*b* can be merged into a relatively flat, multiple-cone rear envelope structure with the remainder of the funnel being made of glass adhered to the metal. In an earlier fabrication method, not now generally used, the cone portion was fabricated from sheet metal, and this technique may be used to advantage for the present multi-beam CRT invention. The complex rear envelope contours may be press-formed in a high-volume production method assuring low cost. The structure may be reinforced with load bearing ribbing such as that shown at 28 which engages the rear multiple cone section 30 to provide a thin light weight assembly. Furthermore, the rib 28 may be extended so as to engage the face plate 4 at a very thin, essentially invisible, line. By engaging both the front and rear of the unit, the rib 28 adds substantial strength. This feature allows the faceplate to be much thinner and lighter than required for a full area unsupported structure. A metal cone 30 may also be of a material which provides magnetic shielding of the electron beams.

Figure 3:
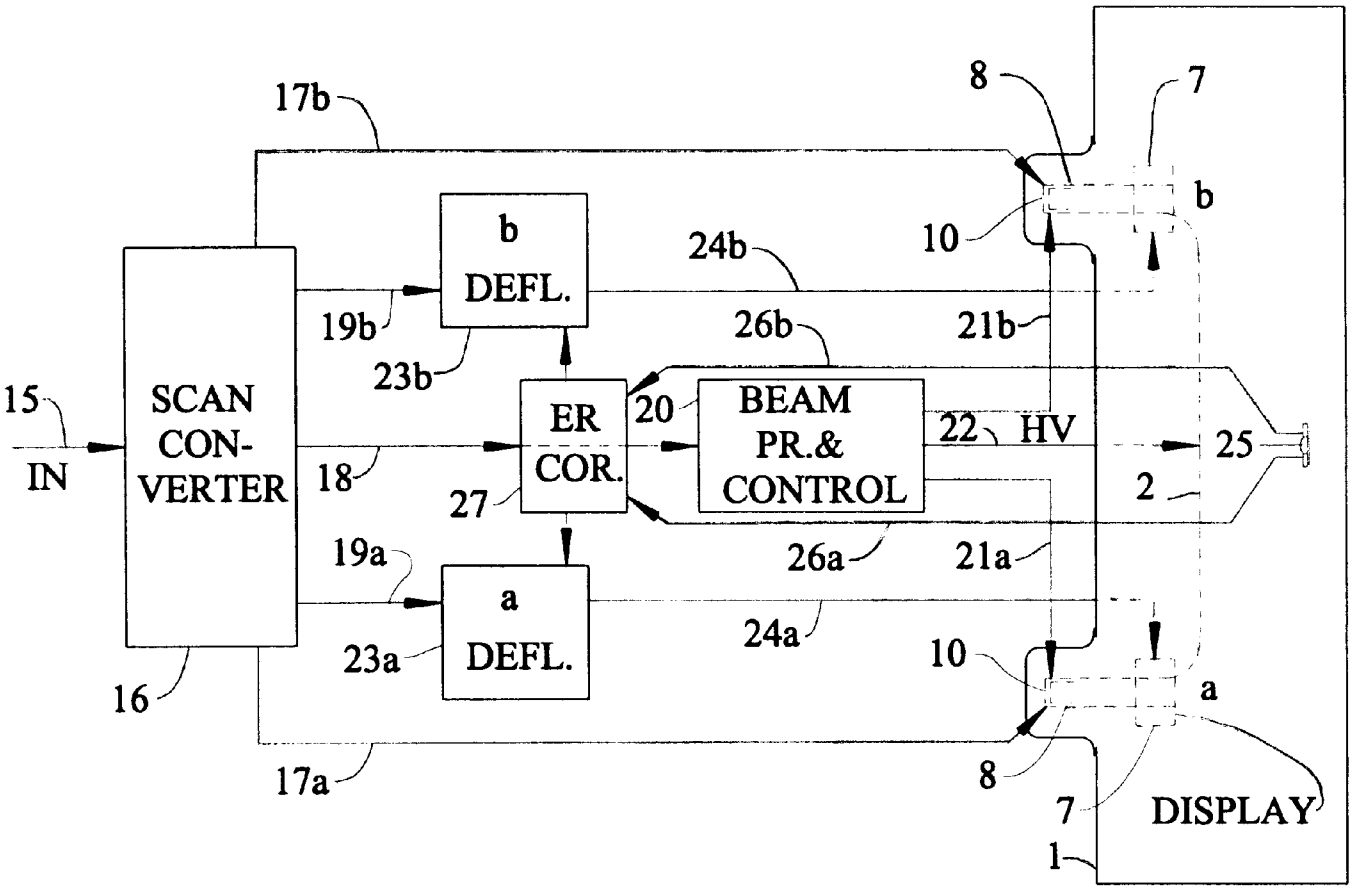
FIG. 3 is a block diagram showing the essential circuit elements of a dual deflection display in accordance with the invention.

The means for providing a working, dual beam display are shown in the block diagram of FIG. 3 and apply to multiple beams. Display input signal 15 enables scan converter 16, which is shown providing 5 principal outputs for control of display 1. The display's video content is separated into left and right sections. Video signal 17*a* feeds electron gun 10*a*. Video signal 17*b* feeds electron gun 10*b*. Line 18 carries beam control information to error correction block 27 and thence to beam power and control circuit section 20 which provides auxiliary control functions such as bias, electrode voltages, focus, etc. as required by the specific type of CRT display used. Signal voltage 21*a* provides control to the elements of cone section 8*a* and signal voltage 21*b* provides control to the elements cone section 8*b*. Line 22 provides high voltage to gun 10 anodes and screen 5. The final two scan converter signals 19*a* and 19*b* provide timing signals to deflection circuits 23*a* and 23*b* respectively. The deflection outputs 24*a* and 24*b* drive deflection yokes 7*a* and 7*b* to provide display beam scan output. Seam edge detectors 25 provide index signals 26*a* and *b* to error correction block 27. Block 27 generates error correction signals fed to deflection blocks 23*a* and 23*b* for correcting corresponding beam scan to conform to format area portions a and b.

The above description provides a general set of functions and their signal flow for providing a dual beam display using one of miscellaneous available state-of-art display methods. It will be recognized that variation in detail as between various methods occurs. It will also be recognized that the dual beam concept can be extended to 3, 4 or more beams to meet special functions or configurations.

I claim:

1. A color CRT display comprising:

a display surface comprising a continuous phosphor screen for generating a visible image in response to impingement by an electron beam;

a plurality of beam generation assemblies for generating and deflecting a plurality of electron beams for impingement on respective contiguous areas of said continuous phosphor screen; and signal means for providing input signals to each of said beam generation means for controlling the motion of each electron beam over its respective area to produce a unified visible image, wherein said phosphor screen comprises a pattern of triads of primary colors and said signal means comprises means for providing dynamic color separation.

2. A CRT display according to claim 1 wherein said signal means comprises scan conversion means for receiving a single input signal containing information relating to the entire said image for providing a signal frame rate and converting said single input signal into a plurality of signal portions, each of which has said signal frame rate and controls a respective one of said beam generation assemblies.

3. A CRT display according to claim 1 wherein said signal means includes scan stabilization and beam error correction means for positioning beam scan of each of said beams precisely within a respective one of said contiguous areas.

4. A CRT display according to claim 3 further comprising beam index means for generating index signals indicating the presence of a said beam at prescribed points including edge points of said areas of said display screen and means responsive to said index signals for controlling the scan of each said beam to match its respective area.

5. A CRT display according to claim 4 wherein said index means comprises a small phosphor area that generates light upon impingement by a said beam and detector means for detecting said light to produce said index signals.

6. A CRT display according to claim 4 wherein said index means comprises an electrically conductive area for producing said index signals upon impingement by a said beam.

7. A CRT according to claim 6 wherein said electrically conductive area is displaced from said screen whereby said electrically conductive area is not visible to a viewer.

8. A CRT according to claim 3 wherein said display screen comprises an envelope having a rear portion made of electromagnetic-shielding material.

9. A CRT display according to claim 1 further comprising index means for generating index signals in response to impingement by a said beam for error correction of each of said beams.

10. A CRT display according to claim 1 further comprising support elements of a rear portion of an envelope of said CRT having their front edges engaging said display surface at edge boundaries of said areas.

11. A CRT according to claim 1 further comprising an envelope having a rear portion opposite said phosphor screen that is made of reinforced, thin metal conformed to mount said beam assemblies and sealed to said display surface.

12. A CRT according to claim 11 further comprising a support element extending between said display surface and said rear portion and engaging said display surface at a small location comprising a narrow line on a boundary between said contiguous areas.

13. A CRT according to claim 1 wherein said triads of primary colors comprise vertical phosphor stripes arranged having the pattern RGB.

14. A CRT according to claim 13 wherein said triads have the pattern RGBGRGBGRGB.

15. A CRT display comprising:

a display surface comprising a continuous phosphor screen for generating a visible image in response to impingement by an electron beam;

a plurality of beam generation assemblies for generating and deflecting a plurality of electron beams for impingement on respective contiguous areas of said continuous phosphor screen;

signal means for providing input signals to each of said beam generation means for controlling the motion of each electron beam over its respective area to produce a unified visible image, and at least one index element associated with a boundary of a said respective area and displaced from said phosphor screen, whereby said index element is not visible to a viewer, wherein said phosphor screen comprises a pattern of triads of primary colors, and said signal means comprises means for providing dynamic color separation.

16. A CRT display according to claim 15 wherein said display surface is glass and said display further comprises an envelope having a rear portion opposite said phosphor screen that is made of reinforced, thin metal conformed to mount said beam assemblies and sealed to said glass display surface.

* * * * *